US005931558A

United States Patent [19]

Chen

[11] Patent Number: 5,931,558

[45] Date of Patent: Aug. 3, 1999

[54] GLEAMY GOBLET STRUCTURE

[76] Inventor: Chiu-Tung Chen, 11-2No. 7, Section Shin Sheng North Road, Taipei, Taiwan

[21] Appl. No.: 09/114,164

[22] Filed: Jul. 13, 1998

[51] Int. Cl.[6] ..... F21V 33/00

[52] U.S. Cl. ..... 362/101; 362/184; 362/806

[58] Field of Search ..... 362/101, 806, 362/154, 184, 190, 191, 230, 231

[56] References Cited

U.S. PATENT DOCUMENTS 3,374,344 3/1968 Rudolph et al. ..... 362/101
3,735,113 5/1973 Stott ..... 362/101
3,878,386 4/1975 Douglas ..... 362/101
5,070,435 12/1991 Weller ..... 362/101
5,879,068 3/1999 Menashrov et al. ..... 362/101

*Primary Examiner*—Thomas M. Sember
*Attorney, Agent, or Firm*—Rosenberg, Klein & Bilker

[57] ABSTRACT

A gleamy goblet structure comprises a goblet with hollowed stem, a housing coupling to the hollowed columnar space of goblet stem, a plurality of tiny color bulbs connected at a cylinder above the housing, and a multisection switch below the housing for switching on any tiny color bulb. The visual effect is enhanced when switching on any single color bulb to emit color ray penetrating the goblet vessel and wine contained therein.

3 Claims, 2 Drawing Sheets

GLEAMY GOBLET STRUCTURE

FIELD OF THE INVENTION

The present invention relates to a gleamy goblet structure, in particular refers to a goblet with hollowed stem below the vessel, with gleaming device therein for emitting color ray penetrating the vessel and wine contained within to enhance the visual effect.

BACKGROUND OF THE INVENTION

In most banquets or other social situation, drinking red grape wine or white grape wine has become a popular trend instead of other alcoholic beverages. With distinguished glitter color and low percent alcohol, wine has played a character enhancing the mood and atmosphere for sipping the wine. However, under dim environment the glitter color of wine is also dimmed and lowered it visual effect when drinking.

OBJECTS OF THE INVENTION

The main object of the present invention is to solve above described problem by providing a gleamy goblet structure having a gleaming device in the hollowed stem enhancing the visual effect by emitting color light ray penetrating the goblet vessel and wine contained therein. The second object of the present invention is to arrange a plurality of tiny color bulbs on the gleaming device enhancing the color effect for different wines contained in the goblet vessel.

DETAILED DESCRIPTION OF THE INVENTION

Figure 1:
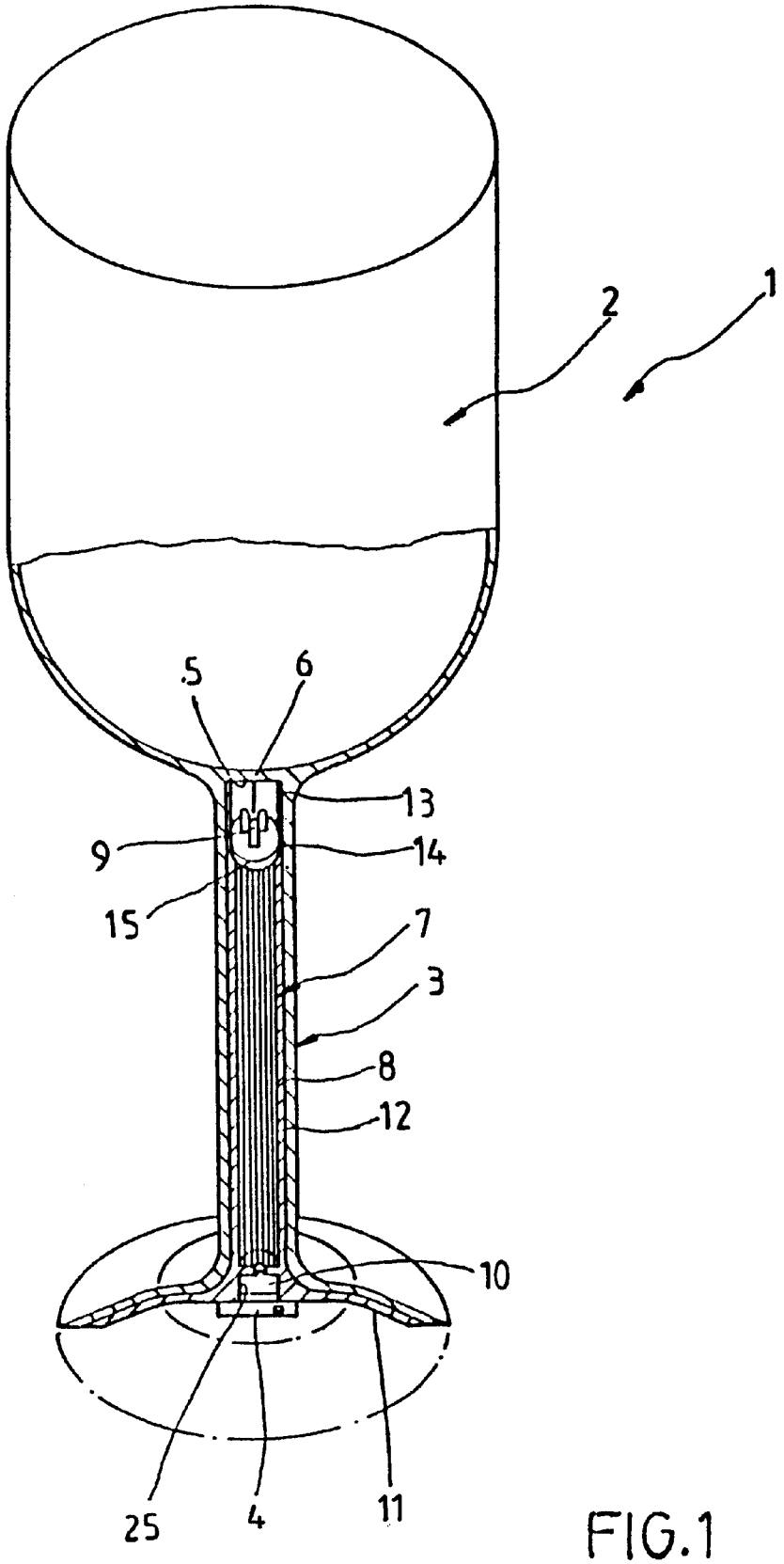
FIG. 1 is the perspective view of this invention with sectional part.

Advantages, structure, and functions of the present invention will be apparent by following description with reference to the drawings.

Now refers to FIGS. 1 and 2, a hollowed stem (3) is extended below a goblet vessel (2) of gleamy goblet (1) of the present invention, having a columnar space (5) with a closed wall (6) at the top formed by the goblet vessel (2) and an opening end at bottom, for coupling to a gleaming device (7). A multisection switch (4) is arranged to control the color light emitted from a plurality of tiny color bulbs (9) for penetrating the closed wall (6) of goblet vessel (2) and wine contained within the vessel (2).

Figure 2:
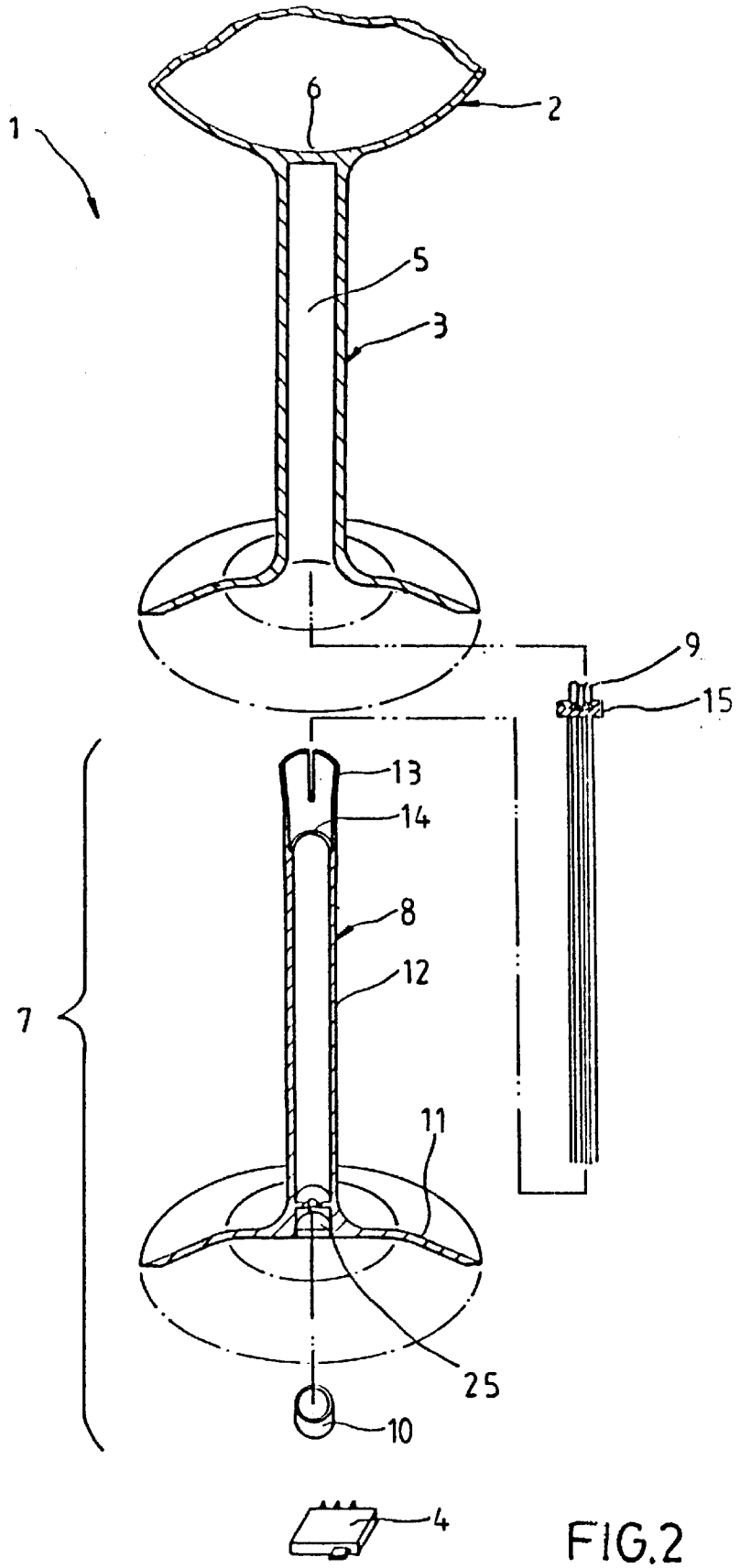
FIG. 2 is the decomposed view of FIG. 1 with partial omission and sectional part.

Further refers to FIGS. 1 and 2 which show the gleaming device (7) of this invention comprising a housing (8), a plurality of tiny color bulbs (9), mercury cell (10), and multisection switch (4). Wherein, the housing (8) comprises a cylinder (12) and base (11) of opaque material, having tightening pawl (13) formed at upper part of said cylinder (12) for coupling along the peripheral wall of the columnar space (5) of the stem (3) with outward friction to fix along the wall of the columnar space (5). A shoulder (14) is formed thereon inside the cylinder (12) beneath said tightening pawl (13) for coupling a connecting base (15) which conjoins a plurality of tiny color bulbs (9), and can possibly be a reflective shield for reflecting any light emitted from the tiny color bulbs (9) and to penetrate the ray to the goblet vessel (2) and wine therein; thereby, the visual effect is enhanced. Said tiny color bulbs (9) are coupled centrally at the connecting base (15) or reflective shield, including red, yellow, green . . . and various color bulbs for emitting a single color light by choosing a single light bulb by switching on a multisection switch (4) disposed under the cylinder (12) for accordance with the color of wine contained therein. A battery holder is disposed at the bottom of the cylinder (12) for containing mercury cells as power supply to the color tiny bulbs (9) and the multisection switch (4) or contact switch disposed under said cylinder (12) functions as control to the power supply and option for turning on any single tiny color bulb.

I claim:

1. A gleamy goblet structure comprises:

a hollowed stem, extended below a goblet vessel having a columnar space with a closed wall at a top formed by the goblet vessel and an opening end at bottom for coupling a gleaming device;

the gleaming device, for emitting color light ray penetrating said goblet vessel and wine contained therein, which comprises:

a housing, consisted of a cylinder and base of opaque material, having tightening pawl formed at an upper part of said cylinder for coupling along a peripheral wall of the columnar space of the stem with outward friction to fix along the wall of the columnar space; a shoulder formed thereon inside the cylinder beneath said tightening pawl for coupling a connecting base which conjoins a plurality of tiny colored bulbs; a battery holder disposed under said cylinder for containing a mercury cell, the mercury cell providing power to the color light;

the plurality of tiny color bulbs coupled centrally at said connecting base for various lighting options;

a multisection switch functioning to control the various lighting options.

2. A gleamy goblet structure according to claim 1, wherein said multisection switch is a contact switch.

3. A gleamy goblet structure according to claim 1, wherein said connecting base for coupling the plurality of tiny color bulbs is characterized as a reflective shield.

* * * * *